US010468788B1

(12) United States Patent
Shapnek et al.

(10) Patent No.: US 10,468,788 B1
(45) Date of Patent: Nov. 5, 2019

(54) MULTI-DIMENSIONAL CABLE SHORTING TOOL

(71) Applicants: National Technology & Engineering Solutions of Sandia, LLC, Albuquerque, NM (US); Daniel M. C. Odell, Aiken, SC (US); Kevin Thomas, Las Vegas, NV (US)

(72) Inventors: Lawrence R. Shapnek, Cedar Crest, NM (US); Charles S. Field, III, Shuqualak, MS (US); WVenner Saul, Los Lunas, NM (US); Nathan A. Davey, Sandia Park, NM (US); Andrew Lee McCourt, Belen, NM (US); Dennis J. De Smet, Bosque Farms, NM (US); Charles A. Walker, Albuquerque, NM (US); Daniel M. C. Odell, Aiken, SC (US); Kevin Thomas, Las Vegas, NV (US)

(73) Assignees: National Technology & Engineering Solutions of Sandia, LLC, Albuquerque, NM (US); Daniel M. C. Odell, Aiken, SC (US); Kevin Thomas, Las Vegas, NV (US)

( * ) Notice: Subject to any disclaimer, the term of this patent is extended or adjusted under 35 U.S.C. 154(b) by 0 days.

(21) Appl. No.: 15/678,638

(22) Filed: Aug. 16, 2017

(51) Int. Cl.

| | |
|---|---|
| ***H01R 4/2404*** | (2018.01) |
| ***H01R 24/28*** | (2011.01) |
| ***F42B 3/18*** | (2006.01) |
| ***F42D 1/05*** | (2006.01) |

(52) U.S. Cl.
CPC ..... *H01R 4/2404* (2013.01); *F42B 3/18* (2013.01); *F42D 1/05* (2013.01); *H01R 24/28* (2013.01)

(58) Field of Classification Search
CPC . F42D 1/045; F42D 1/05; F42D 1/055; F42C 15/40; F42C 19/12; F42B 3/12; F42B 3/13; F42B 3/182; F42B 3/18; H01R 31/06; H01R 31/02; H01R 11/24; H01R 11/282; H01R 11/28; H01R 4/4845; H01R 4/4827; H01R 4/2404; H01R 24/28
USPC ..... 102/202.7, 206; 439/506, 502–504, 828, 439/829
See application file for complete search history.

(56) References Cited

U.S. PATENT DOCUMENTS 1,942,325 A * 1/1934 Davidson ..... A43B 3/00 200/86.5
2,062,189 A * 11/1936 Olin ..... F42B 39/30 102/202.12
2,389,255 A * 11/1945 Graham ..... H01R 4/2404 29/874

(Continued)

*Primary Examiner* — Gary F Paumen
(74) *Attorney, Agent, or Firm* — Daniel J. Jenkins

(57) ABSTRACT

A device for rendering safe a detonator firing circuit by short circuiting multiple conductors in the circuit includes a base portion and cable piercing members. The base portion has a cylindrical block and apertures for retentively receiving the cable piercing members. The cable piercing member has a first end to impinge on and penetrate a cable insulation when forcibly attached to an external surface of the cable. The cable piercing member has a low electrical resistance and impedance to generate a short circuit between conductors of the cable. Also, a method for rendering safe a detonator firing circuit of by short circuiting multiple conductor cables or a pigtail connector of a detonator system.

11 Claims, 5 Drawing Sheets

(56) References Cited

U.S. PATENT DOCUMENTS 2,491,552 A * 12/1949 De Grace ..... F21L 14/00 362/117
2,748,704 A * 6/1956 Dinsmoor ..... F42C 11/00 102/229
3,115,541 A * 12/1963 Hanner ..... H01R 4/2404 174/88 R
3,745,228 A * 7/1973 Vogt ..... H01R 4/2412 174/88 R
3,817,180 A * 6/1974 Finger ..... F42C 7/02 102/427
3,828,297 A * 8/1974 Hoza, III ..... H01R 31/06 439/105
4,620,483 A * 11/1986 Simpson ..... F42C 1/14 102/216
4,854,239 A * 8/1989 Van Sloun ..... F42C 15/188 102/229
5,055,065 A * 10/1991 Pearl ..... H01R 4/2404 439/417
5,367,251 A * 11/1994 McTigue ..... G01R 1/067 324/133
5,447,450 A * 9/1995 Woodward ..... G01R 1/06788 439/417
5,894,103 A * 4/1999 Shann ..... F42D 1/055 102/215
6,135,806 A * 10/2000 Pohjola ..... H01R 12/67 439/422
6,238,236 B1 * 5/2001 Craft, Jr. ..... H01R 13/5812 439/369
6,386,901 B1 * 5/2002 Caldwell ..... H01R 4/2404 439/404
7,416,440 B2 * 8/2008 Homyk ..... H01R 31/06 439/502
2007/0173104 A1 * 7/2007 Veronesi ..... B66B 7/062 439/425
2008/0245251 A1 * 10/2008 Van Wyk ..... F42D 1/05 102/200
2011/0127946 A1 * 6/2011 Anderson ..... B60L 11/1818 320/101
2016/0223304 A1 * 8/2016 Vabnick ..... F42B 8/28

* cited by examiner

MULTI-DIMENSIONAL CABLE SHORTING TOOL

STATEMENT REGARDING FEDERALLY SPONSORED RESEARCH OR DEVELOPMENT

This invention was developed under Contract No. DE-NA0003525 awarded by the United States Department of Energy/National Nuclear Security Administration. The Government has certain rights in this invention.

BACKGROUND OF THE INVENTION

The application generally relates to a tool for short circuiting a cable and system and method therefor. More specifically, the application discloses a device for rendering safe a firing circuit for an explosive device.

Upon accessing a target one of the initial actions of a render-safe procedure (RSP) for an electrical firing system is to attack or interrupt the initiator and/or detonator cables. Options may be to cut, short, or measure to determine if cutting or short-circuiting is appropriate. Each of these approaches may at times have merit depending on the available time and the relative sophistication of the system.

Subsequent to an RSP for explosive devices, the detonation initiator device may be still attached to stubs of the cables and need to be electrically short-circuited or rendered safe to protect against initiation from static discharge or other inadvertent current flow.

As access may be extremely limited initially, only a few of many cables may be accessible to be short-circuited, or attacked, unless or until access holes may be opened or created. For many initiator cable types, even when access is available, short-circuiting can be difficult due to various conditions, e.g., small or tough cables, poor environment, etc., and may require minutes for disabling each cable, suggesting complex multi-cable systems could take a considerable amount of time to manually attack and fully disable, e.g., from tens of minutes to hours.

High-energy firing systems for exploding bridgewires (EBWs) or slapper initiators may be susceptible to short-circuiting or arcing in one of the firing circuit cables. In experiments using shorts against the firing cables in systems using inert EBW, or bare headers, varying amounts of smoke and noise when fired suggested that current flow and energy distribution was being compromised, thus affecting system performance.

Due to the complexities of LRC circuits that comprise EBW firing systems, it was considered that for systems such as in a light weight or weak-link system an attack such as this may be relied upon to disable, or safe, the entire firing system.

What is needed is a render-safe procedure, or RSP, that provides a substitute for cutting firing-circuit cables during initial RSP, which provides additional time for emergency personnel to determine appropriate follow-on processes.

BRIEF SUMMARY OF THE INVENTION

One embodiment relates to a device for rendering safe a detonator firing circuit by short circuiting multiple conductors in the circuit includes a base portion and cable piercing members. The base portion has a cylindrical block and apertures for retentively receiving the cable piercing members. The cable piercing member has a first end to impinge on and penetrate a cable insulation when forcibly attached to an external surface of the cable. The cable piercing member has a low electrical resistance and impedance to generate a short circuit between conductors of the cable.

Another embodiment relates to a method for rendering safe a detonator firing circuit by short circuiting multiple conductors in the circuit, including, in a firing system for initiating a detonation, having a detonator system and a firing system in electrical communication over a transmission cable extending between the firing system and detonator system, providing a cable piercing device having a base portion and at least one cable piercing member having low electrical resistance; applying at least one cable piercing device at a point along the transmission cable and piercing the cable; creating a short circuit within the cable between the firing system and the detonator system and preventing electrical current and energy from initiating a detonation of a detonator bridge located in the detonator system.

Yet another embodiment discloses a method for rendering safe a detonator system for transporting a detonator bridge safely by short circuiting multiple conductors in the circuit includes providing a cable piercing device having a base portion and at least one cable piercing member having low electrical resistance; and applying the cable piercing device at across detonator system input terminals.

One advantage is the use of low resistance or impedance cable piercing devices, or talons, to create parallel circuit paths with each respective initiator bridge to divert the majority of the firing current or energy away from an initiator for an explosive device. A cable piercing device of the present invention comprises talons, or small conductors, to short-circuit the initiator cables of a live firing system as a render-safe procedure (RSP).

An alternate mode, or further-safe mode, applies to the best practice of short-circuiting detonation initiators for safe transport. In this mode a talon may be used for mitigating static and coupled currents to detonation initiators removed from a system.

The disclosed invention describes the effectiveness of a cable piercing talon for safing multiple types of explosive firing systems, and provides methods for usage of the cable piercing device wherein in operation, the methods may be effective to assist emergency personnel in determining the best course of action for rendering safe an explosive device.

Other advantages include the use in counter improvised nuclear device missions, counter improvised explosive devices (IGD) or counter weapons of mass destruction (WMD) missions, to render safe such weapons. Another application of the talon may be civilian applications, e.g., explosive ordinance disposal (GOD), and law enforcement applications, e.g., alarm system defeat. Still further applications include field troubleshooting, maintenance and repair of hardwire telecom communications systems (COTS).

The disclosed talon provides a manual tool capable of performing dozens of "shorts" quickly and requiring no maintenance. The cable piercing tool may be used for two modes of short-circuiting: render-safe mode wherein cables are short-circuited in order to render the system safe; and an alternate safe-mode wherein a pigtail or cable fragments that remain attached to the detonation initiators after they have been removed from the target are short-circuited in order to mitigate the effects of static or coupled currents on the detonation initiator.

In all embodiments the base portion is physically and electrically attached to the piercing members. Additionally, the base plate is used to apply force to the assembly so that the piercing members can be driven into the cable.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
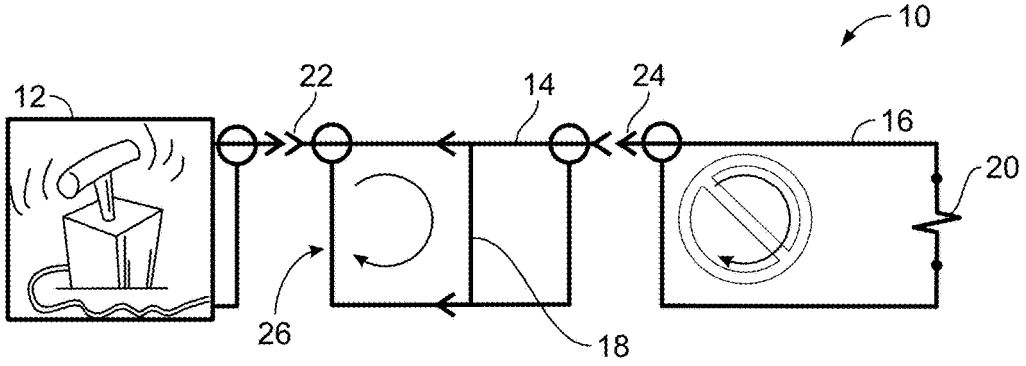
FIG. 1 shows an exemplary embodiment of a live firing circuit in render-safe mode.

Referring to FIG. 1, an exemplary embodiment of a live firing circuit 10 represents a render-safe mode of the detonator firing circuit 10 using a cable piercing device 100 (FIG. 5) to short circuit a live firing circuit. Cable piercing device is also referred to as a talon 100. Talon 100 is represented schematically as short circuit 18 in FIG. 1. Firing circuit 10 includes three circuit elements. Firing system 12 provides the electrical signal to initiate a detonation of a detonator bridge 20 in detonator system 16. Transmission cables 14 extend between firing system 12 and detonator system 16 to transmit the electrical signal from firing system 12 to detonator system 16. Transmission cables 14 are connected to firing system 12 via connector 22 and to detonator system 16 via connector 24. Talon 100 may be applied at any point along cables 14 by piercing the cables 14 to create a short circuit between firing system 12 and detonator system 16, thereby preventing electrical current and the associated energy from initiating a detonation of detonator bridge 20. Electrical current flow is diverted via short circuit 18 in talon 100, as indicated by arrow 26, and the firing circuit 10 is rendered safe from triggering a detonation.

Talon 100 includes multiple piercing members 50, as described below with respect to FIG. 5, which are conductive. Low resistance or impedance across talon 100 creates parallel circuit paths with one or more respective initiator bridges, diverting the majority of firing current or energy 26 away from the detonator system 16.

Figure 2:
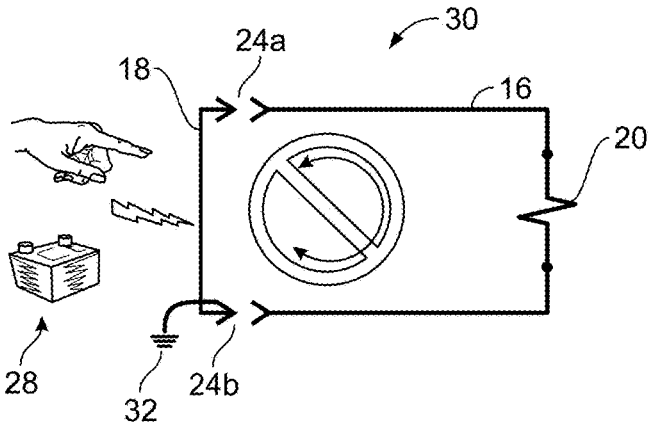
FIG. 2 shows an embodiment of another embodiment of a firing circuit in a safe transport mode.

Referring next to FIG. 2, in an alternate embodiment another safe mode for a detonator system 16 may be achieved, e.g., for use in transporting a detonator bridge safely by preventing static discharge or other voltage source from applying a spurious initiator signal to detonator bridge 20. Talon 100 may be applied across detonator system input terminals 24*a* and 24*b*. Any voltage potential originating from energy source 28 is diverted to ground 32 via talon 100 indicated by short circuit arrows 18. This alternate mode is used to mitigate static and coupled currents to detonators 20 after removal from system 10.

The circuit 30 short circuits detonator conductors, or pigtails, via low resistance across terminals 24*a*, 24*b*.

Figure 3:
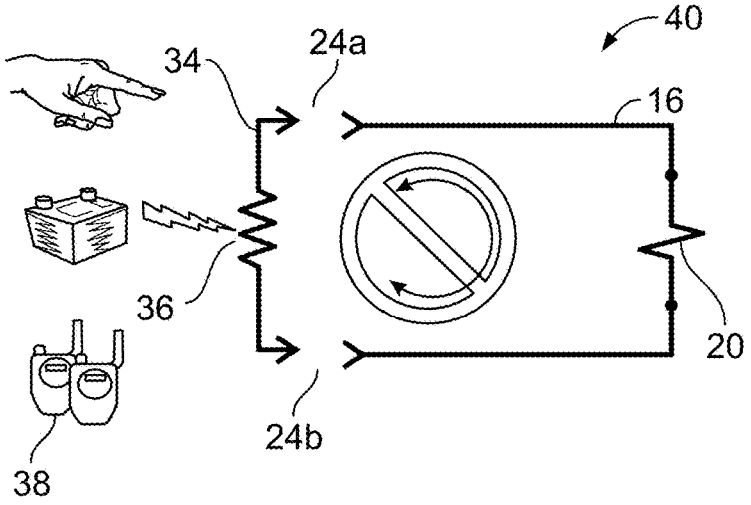
FIG. 3 shows an alternate embodiment of a firing circuit in a safe transport mode.

Referring next to FIG. 3, yet another alternate embodiment of a modified render safe system 40 is disclosed for providing a resistive bridge 34 across input terminals 24*a*, 24*b* of detonator system 16. A higher resistance value 36 between terminals 24*a*, 24*b* may be achieved by providing piercing members 50 with powdered metal oxides and specially doped semiconductor portions. In this embodiment, the talon 100 may protect against radio frequency (RF) induced currents. RF signals may be generated by RF equipment 38 or static electricity sources 28.

Figure 5:
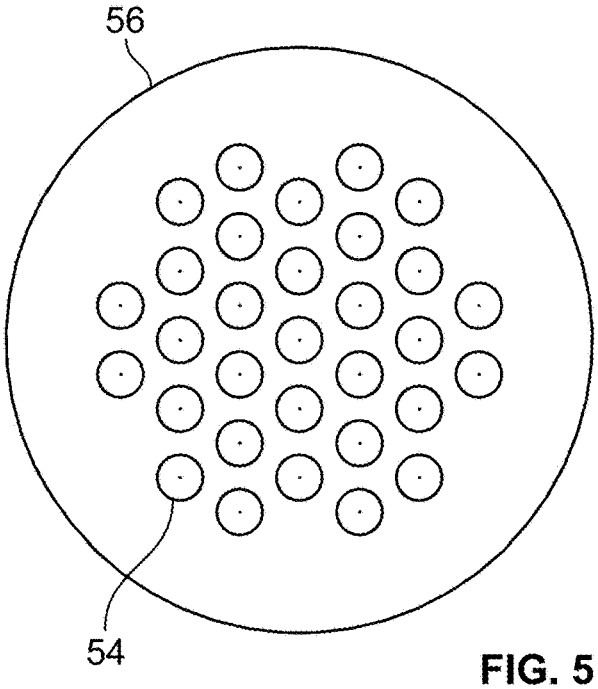
FIG. 5 shows an exemplary talon configured with a plurality of prongs mounted in a perforated base plate.
Figure 6:
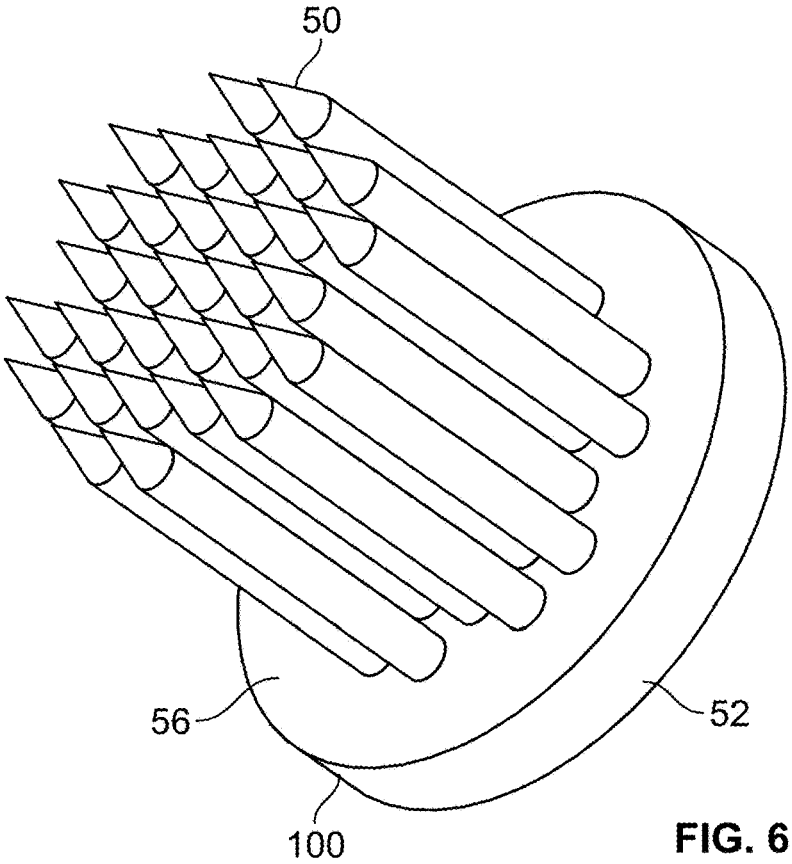
FIG. 6 shows an exemplary base plate of FIG. 5.
Figure 7:
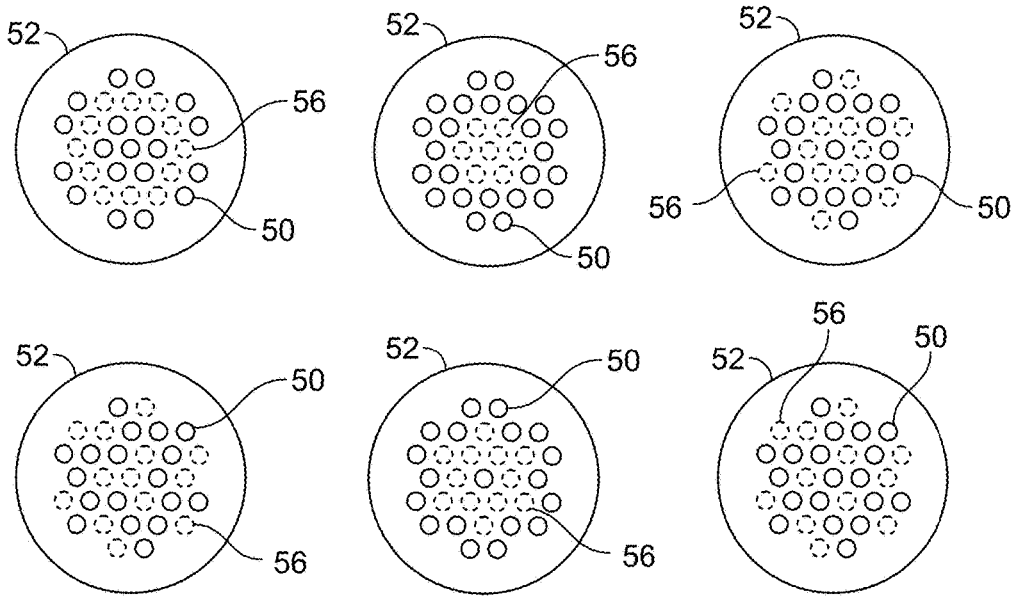
FIG. 7 shows multiple array patterns for prongs installed in the base plate of FIG. 6.

Referring next to FIG. 5, an exemplary talon 100 is shown. Talon 100 is arranged with a plurality of piercing members, or pointed prongs 50. Piercing members 50 may be fixedly mounted in a perforated base plate 52. Base plate 52 may be a disc or other block of material sufficient to attach piercing members 50 for applying forcibly to, e.g., a cable jacket and penetrate through cable layers and cable conductors. FIG. 6 shows an exemplary configuration for base plate 52 showing apertures 54 for receiving piercing members 50. Piercing members 50 are fixedly attached to base plate 52 via apertures, so that piercing members 50 extend substantially perpendicularly from a surface 56 of base plate 52. FIG. 7 shows six alternate prong arrays or patterns for arranging piercing members 50 in base plate 52. Apertures 56 are indicated in broken lines, indicating an aperture without a prong inserted therein. Solid circles represent prongs 50. Prongs 50 may also include barbs, knurled surfaces or similar features to help to hold the prongs 50 in the cable.

Figure 8:
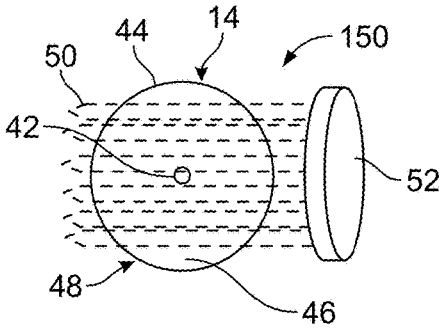
FIG. 8 shows an exemplary coaxial cable sectional view with a talon installed therethrough.
Figure 9:
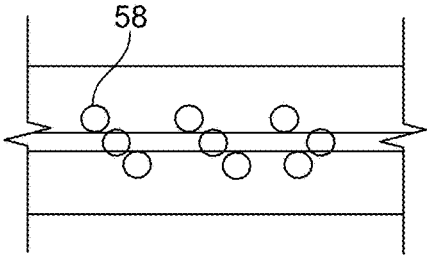
FIG. 9 shows a longitudinal schematic view of a coaxial cable with multiple talons installed at intervals along the cable length.

Referring to FIG. 8, an exemplary placement of a talon 100 in a coaxial transmission cable 14 by short circuiting a core conductor 42 with an external shield conductor 44, which conductor 44 may be grounded or floating potential. Piercing members 50 penetrate external shield conductor 44, cable jacket 48 and core insulation 46, to create a low resistance or impedance between the external shield conductor 44 and core conductor 42, to prevent current to the detonator system as discussed above. Piercing members 50 may be spaced apart by a distance less than the diameter of a core conductor 42, if known, in order to ensure contact between at least one piercing member 50 and core conductor 42. If the transmission cable 14 is a twisted pair cable or other multi-conductor cable it is more likely that the short circuit will be visible to a person installing the talon 100. As shown in FIG. 9, multiple talons 100 may be installed at various points 58 along a longitudinal section of transmission cable 14. Also the angle at which talons 100 impinge on transmission cable 14 may be varied circumferentially to increase the probability of creating a short circuit between external shield conductor 44 and core conductor 42. Multiple talons provide multiple short circuit paths between external shield conductor 44 and core conductor 42. While the exemplary embodiment has been described in application to coaxial transmission cable 14, the talon 100 may be applied in transmission cables 14 comprised of parallel multi-conductor transmission cables, twisted pair and twisted multi-conductor cables as well. Further, in an embodiment, at least one conductor of the coaxial and multi-conductor cables may be grounded, although a grounded conductor is not required in order for talon 100 to function.

Figure 4:
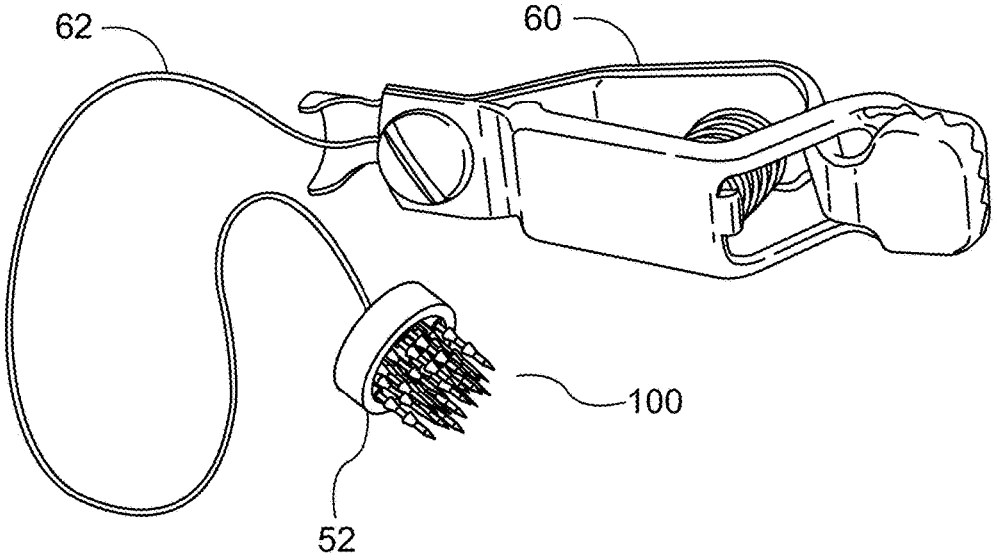
FIG. 4 shows an embodiment of a talon having a grounding clamp.

Referring next to FIG. 4, a talon 100 may be attached to a grounding clamp 60, e.g., an alligator clip as manufactured by Mueller Electric Co. The clamp may be attached at base 52, or to any prong 50 via a wire portion 62. Possible applications may include sating of initiator cabling 14 that uses a common ground through the mechanical assembly; killing other fireset components such as high-voltage power supplies and capacitors; grounding the target to the environment for electrical safety; or as tools for sating the components removed from a firing circuit 10. In some cases, a series resistance (not shown) may be installed in-line in the tethers to limit current therethrough.

Figure 10:
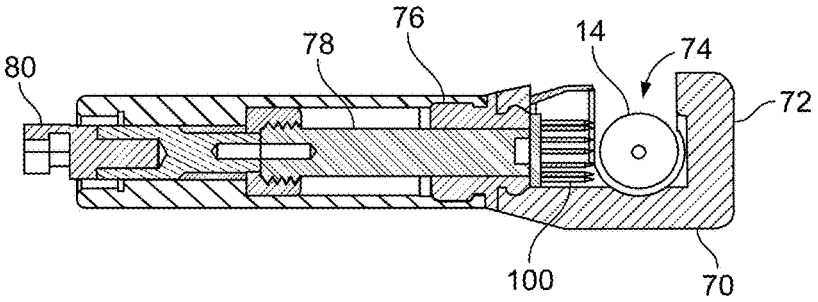
FIG. 10 shows a tool for installing a talon in a cable.

Referring next to FIG. 10 a tool is shown for installing a talon 100 in a transmission cable or pigtail. A yoke 70 includes an anvil 72 and a semi-circular channel 74 for receiving a transmission cable. a hollow tube 76 with a sliding cylindrical shaft 78 is disposed on yoke 70 on the opposing side of channel 74 from anvil 72. An end portion 80 is movably attached to a distal end of tube 76. End portion 80 provides a striker to forcibly drive talon 100 into channel 74, e.g., with a hammer or other drive mechanism, such that talon 100 penetrates a cable 14 resting in channel 74. Anvil 72 provides a strike plate that resists lateral movement of cable 14 in yoke 70, to ensure that talon 100 penetrates cable 14 and creates a short circuit therein.

In field tests talons installed within three inches from a detonator system 16; and having a resistance less than five milli-ohms (5 mohm) had the greatest impact on system safing and that firing circuits 10 having fewer cables present less of an opportunity for a successful talon attack. A talon attack may provide emergency personnel with additional time to converge on a subsequent procedure for rendering safe a firing circuit 10. For exploding bridgewires (EBWs) a talon attack on nearly any part of a cable effectively causes a short circuit for that cable and if there are sufficient cables, e.g., greater than 80%, robust systems can be sated. For hot-wire (HW) systems, a talon attack can safe systems with instantaneous power up to 1 kW or that incorporate commonly encountered commercial initiators, e.g., 1 A/1 W; however, since HW initiators can function in different modes, e.g., minimum energy or minimum power, attacks on specific HW cables seldom kill a particular cable, and moderate or even low-powered systems may not be sated unless all cables are attacked.

Figure 11:
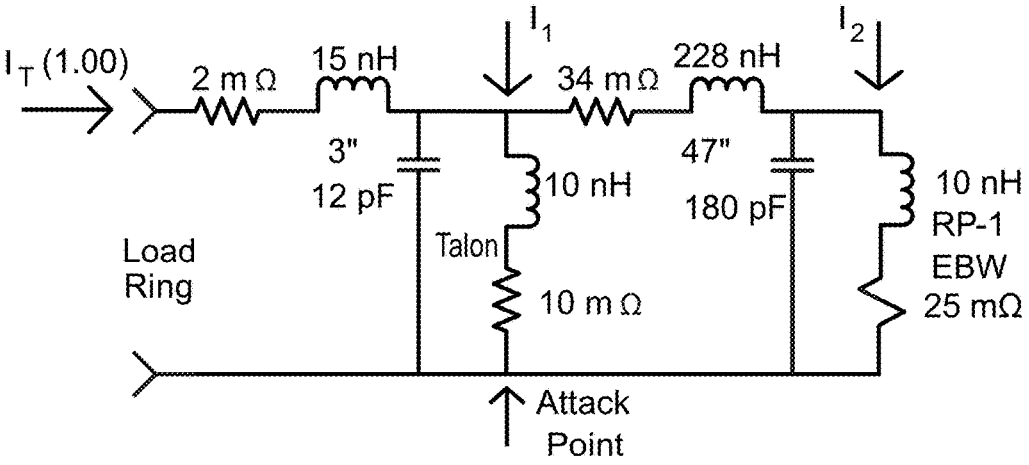
FIG. 11 shows a schematic diagram for a single cable equivalent circuit in a parallel cable arrangement according to an embodiment of the disclosure.

Referring next to FIG. 11, when examining the effect of a talon 100 on a high-performance system, a simple current divider approach provides a $1^{st}$ order approximation. FIG. 11 is a schematic diagram for a single cable equivalent circuit in a parallel cable arrangement. FIG. 11 represents a four foot long EBW firing cable with a talon installed. The per unit input current $I_T$=1.00 is input into a load ring or detonator system 16 having 2 mΩ input resistance in series with 15 nH inductance in parallel with a12 pF capacitance. A talon 100 is applied in parallel with the input LRC components across the cable circuit conductors, the talon having 10 nH and 10 mΩ series impedance. The EBW load is connected in parallel with talon 100 with line LRC impedance of 34 mΩ, 228 nH and 180 pF, in series with EBW having 10 nH and 25 mΩ characteristic impedance. Starting with the EBW itself, the typical manufacturer's threshold burst currents ($I_{bmin}$) are ~180 A, but depending on system di/dt, specific configuration, and statistical variation, EBWs can function at currents as low as 100 amperes (A). This leads to 90 A absolute threshold where no detonations or deflagrations are observed.

A vacuum braze may be used to fabricate the base plate with the cable piercing members. Also, silver plating the entire assembly after braze may be used to provide a low resistance coating to further decrease the resistance of the assembly. Additionally, a rhodium flash may be applied to the entire assemble after silver plating the assembled device to protect the silver from oxidation.

In one embodiment, the talon 100 may be fabricated with the base and brazed together. Brazing establishes a robust mechanical attachment and provides a foundation for achieving a low electrical resistance path between each prong or cable piercing member 50. Prongs 50 may be brazed directly into the base plate 52. Brazed talon assemblies may undergo a controlled cooling process, i.e., heat treat, to obtain the desired hardness. In an exemplary embodiment, a target hardness of 56 HRC is preferred. Base plate 52 may be fabricated with 4340 or 4140 steel to be compatible with the braze compound and plate, i.e., silver and heat stress relief processes, thermal coefficient and magnetic requirements.

Braze filler metal preforms and fixtures may be composed in part of BNi-6 discs, 0.002" thick and 0.3125" diameter, made with a simple manual punch and die set. Brazing fixtures may be laser machined from 0.040" thick 96% alumina ceramic.

All components are preferably brazed or heated in a furnace, including fixturing and braze filler metal. The components are cleaned using a 4-step process comprising vapor phase degreasing (Lenium), an acetone rinse, an alcohol rinse; and air or dry nitrogen dry. The alumina fixtures require additional cleaning; an air-firing process at about 1000° C. for 60 minutes may be used.

Prongs 50 are inserted into the base 52. Tapping on the end of the prongs ensures that the prongs 50 are seated properly in the base 52. A braze filler metal preform is resistance welded using as low a power setting as possible; e.g., about 5 Watt-seconds; in order to maintain the preform positioning throughout the assembly process. A thin alumina plate is positioned over the preforms to help insure prongs 50 do not float upward when the filler metal becomes liquid during brazing. Small tungsten or stainless steel weights may be used to maintain loading or about 5 to 10 grams on the alumina plate 52.

In a preferred fabrication process the furnace atmosphere may be comprised of AWS-7, pure dry hydrogen. The dew point is preferably less than or equal to −40° C. to properly reduce oxides and leave the parts in a condition ready for subsequent plating. The dew point of the dry hydrogen is preferably about −95'C, but if unavailable, a best practice is to use the best possible hydrogen available.

In another embodiment, the furnace type used to braze and heat-treat the talon assemblies is a controlled-atmosphere batch-type furnace. Batch-type furnaces are ideal for process development or when complex program cycles with many controlled ramp and/or soak cycles are required. The furnace schedule chosen allows for proper homogenization of the materials, brazing and heat-treatment during the cooling phase. A furnace control and separate work thermocouple are used to insure that the assemblies reach proper temperatures to accomplish the braze and also adequately harden and toughen during cool down.

An exemplary furnace temperature cycle is as follows: 15° C./minute from ambient temperature to 900° C.; 10° C./minute to 980° C., soak for 5 minutes (brazing step); 25° C./minute to 850° C., soak 30 minutes (solutionizing homogenizing step); furnace cool to room temperature (uncontrolled cool-down as fast as the furnace will allow). After cooling the furnace atmosphere is switched from hydrogen to nitrogen to purge hydrogen from the chamber to levels safe for opening. This may need to be modified for the 4140 material.

Alternatively, laser welding may be used for attachment of the prongs to the base, e.g., for higher volume production.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the multi-dimensional cable short-circuiting tool as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

It should be noted that although the figures herein may show a specific order of method steps, it is understood that the order of these steps may differ from what is depicted. Also, two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

The invention claimed is:

1. A method for rendering safe a detonator firing circuit by short circuiting multiple conductors in the circuit, comprising:

in a firing system for initiating a detonation having a detonator system and a firing system in electrical communication over a transmission cable extending between the firing system and detonator system;

providing a cable piercing device having a base portion and at least one cable piercing member having low electrical resistance;

applying at least one cable piercing device at a point along the transmission cable and piercing the cable;

creating a short circuit within the transmission cable between the firing system and the detonator system and preventing electrical current and energy from initiating a detonation of a detonator bridge located in the detonator system.

2. The method of claim 1, further comprising:

diverting electrical current flow from the firing system via the short circuit via the at least one cable piercing member contacting at least one conductor of the multiple conductors;

and rendering the firing circuit safe from triggering a detonation in the detonator system.

3. The method of claim 2, wherein the base portion comprising a block and at least one aperture for retentively receiving the at least one cable piercing member.

4. The method of claim 3, further comprising:

forcibly attaching the at least one cable piercing member and impinging on an external surface of the transmission cable; and penetrating the external surface of the transmission cable to short circuit conductors in the cable.

5. The method of claim 4, further comprising:

attaching a leadwire to the base portion and grounding the short-circuited conductors via a clamp connected to the leadwire.

6. The method of claim 5, further comprising:

generating a short circuit between a first conductor and a second conductor of the multiple conductor cable through the cable piercing member having a low electrical resistance and impedance.

7. A method for rendering safe a detonator system for transporting a detonator bridge safely by short circuiting multiple conductors in the circuit comprising:

providing a cable piercing device having a base portion and at least one cable piercing member having low electrical resistance; and applying the cable piercing device across detonator system input terminals.

8. The method of claim 7, further comprising:

attaching a grounding clamp to the base portion and grounding the base portion.

9. The method of claim 7, further comprising:

diverting energy to ground via the cable piercing device to mitigate static and coupled currents to a detonator in the detonator system.

10. The method of claim 7, further comprising:

transporting the detonator system.

11. The method of claim 7, further comprising:

grounding the short-circuited conductors via a clamp connected to a cable connected to the cable piercing device.

* * * * *